US006843217B2

(12) United States Patent
Zwick et al.

(10) Patent No.: US 6,843,217 B2
(45) Date of Patent: Jan. 18, 2005

(54) INTEGRATED ELECTRICAL CONNECTORS FOR FUEL INJECTORS

(75) Inventors: James R. Zwick, Lemont, IL (US); Graylan Valentine, Aurora, IL (US); John Forish, Huntertown, IN (US); Edward A. Ort, Garrett, IN (US); Joyce Pagtaconan, Park Ridge, IL (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 10/653,442

(22) Filed: Sep. 2, 2003

(65) Prior Publication Data

US 2004/0074464 A1 Apr. 22, 2004

Related U.S. Application Data

(60) Provisional application No. 60/408,046, filed on Sep. 4, 2002.

(51) Int. Cl.[7] ..... F02P 9/00

(52) U.S. Cl. ..... 123/143 C; 123/647; 123/468; 123/470; 123/195 E

(58) Field of Search ..... 123/193.5, 184.61, 123/647, 143 C, 468, 470, 195 A, 195 C, 195 E

(56) References Cited

U.S. PATENT DOCUMENTS 4,950,171 A * 8/1990 Muzslay ..... 439/76.1
5,030,116 A * 7/1991 Sakai et al. ..... 439/130
5,035,637 A 7/1991 Mathews et al.
5,062,405 A 11/1991 Daly
5,097,594 A 3/1992 Daly et al.
5,127,382 A * 7/1992 Imoehl ..... 123/470
5,163,406 A 11/1992 Daly et al.
5,347,969 A * 9/1994 Gmelin et al. ..... 123/456
5,390,648 A 2/1995 Yanase
5,642,704 A 7/1997 Gogots et al.
5,771,850 A 6/1998 Okada
5,794,603 A * 8/1998 Miyamoto ..... 123/634
6,083,015 A * 7/2000 Vargas et al. ..... 439/130
6,247,435 B1 6/2001 Munz et al.
6,308,686 B1 10/2001 Mammarella et al.
6,341,967 B1 * 1/2002 Nabeshima et al. ..... 439/130
6,494,193 B2 * 12/2002 Weingaertner et al. ..... 123/647
6,564,775 B1 * 5/2003 Kikuta et al. ..... 123/456
6,612,290 B2 * 9/2003 Nozaki et al. ..... 123/456
6,622,700 B2 * 9/2003 Lee et al. ..... 123/456
6,622,711 B1 * 9/2003 Skinner et al. ..... 123/634
6,672,272 B2 * 1/2004 McGloin ..... 123/195 C
2002/0043256 A1 4/2002 Munz et al.
2002/0117141 A1 8/2002 Zielke
2002/0117151 A1 8/2002 Warner et al.
2002/0139344 A1 10/2002 Kitada et al.

* cited by examiner

*Primary Examiner*—Hai Huynh
(74) *Attorney, Agent, or Firm*—Howard & Howard

(57) ABSTRACT

An independent electrical module 26 distributes an electrical signal to the terminals 24 of a fuel injector device in an engine. The module 26 comprises a self-supporting plastic lead frame 28 with copper ribbons 30 disposed on the plastic frame 28. Pluralities of terminal connectors 32 are separate from and movable relative to the frame 28 for being connected to the terminals 24. The ribbons 30 continue in a free and self-sustaining support portions 31 between the frame 28 and the terminal connectors 32 and are bendable for allowing movement of the connectors 32 relative to the frame 28. Each of the connectors 32 includes a polymeric body defining a pair of the sockets 36 with an electrical contact 38 in each of the sockets 36 and a pair of the bendable support portions 31 paired with the contacts 38 in each connector 32.

13 Claims, 3 Drawing Sheets

INTEGRATED ELECTRICAL CONNECTORS FOR FUEL INJECTORS

CROSS-REFERENCES TO RELATED APPLICATIONS

This application claims the priority and benefits of provisional application Ser. No. 60/408,046 filed Sep. 4, 2002.

BACKGROUND OF THE INVENTION

1. Field of the Invention

This invention relates generally to diesel engines having provision for electrical connections with fuel injectors of the engine.

2. Description of the Related Art

Diesel engines are equipped with electronic actuated fuel injectors that meter a fuel mixture into the combustion chambers of the cylinders for operation of the engine. Typically, each fuel injector assembly is equipped with a solenoid having a threaded tip end disposed within an open space of a rocker housing of the engine. The rocker housing is fabricated of cast aluminum and is bolted to the head of the engine. The threaded tip end of each injector is connected to an internally threaded lock nut carried at the end of individual electric lead wires which are routed within the rocker housing to locate the lock nut connecting ends adjacent the threaded tip ends of the injectors and tied to the frame at designated locations. The wires come together in a common multi-lead connector module which extends through an opening in the rocker housing for connection with a mating multi-lead connector carried at the ends of multiple lead wire of the engine's electrical system for delivering electrical power to the individual solenoids.

The prior art has improved the distribution of electrical signals by integrating the electrical leads in the valve cover and other components of the engine. Such systems are disclosed in U.S. Pat. No. 5,390,648 to Yanase and U.S. Pat. No. 5,771,850 to Okada, as well as U.S. Patent Publication 2002/0139344 A1. However, in case of a malfunction requiring replacement, the entire engine component must be replaced.

SUMMARY OF THE INVENTION AND ADVANTAGES

Accordingly, the subject invention provides an electrical module for distributing an electrical signal to the terminals of one of an ignition and a fuel injector device in an engine. The invention comprises a self-supporting lead frame with ribbons of electrically conductive material disposed on the frame and a plurality of terminal connectors separate from and movable relative to the frame for being connected to the terminals.

The module, which is separately formed, may be supported on the rocker housing as a one-piece, integrated structure with multiple lead ribbons incorporated into a single piece. The module is preferably supported on an upper surface of the rocker housing and carries push-on connectors at the ends of the leads for push-on connection with the threaded terminals of associated fuel injectors of the engine. All that is required to make a connection with the threaded stud terminals of existing fuel injector assemblies of a diesel engine is to simply align and press the push-on connectors extending from the lead frame onto the threaded terminals of the injectors.

BRIEF DESCRIPTION OF THE DRAWINGS

These and other features and advantages of the present invention will become more readily appreciated when considered in connection with the following detailed description and appended drawings, wherein.

DETAILED DESCRIPTION OF PREFERRED EMBODIMENT

Figure 1:
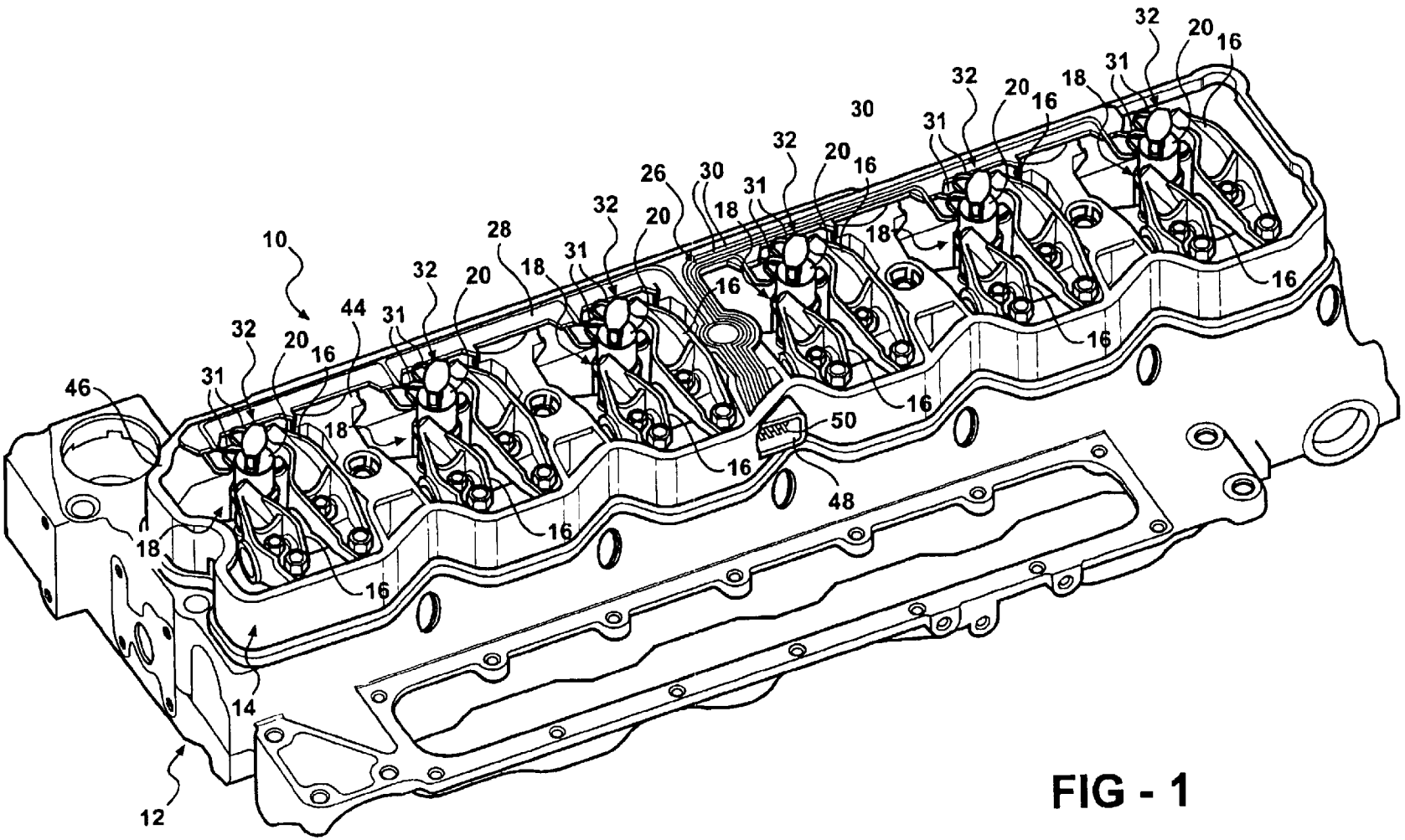
FIG. 1 is a fragmentary perspective view of a diesel engine fitted with a stamped lead frame circuit integrated with a rocker housing and having push-on connectors.

Referring to the drawing, wherein like numerals indicate like parts throughout the views, a diesel engine, generally shown at 10, is fitted with a cylinder head, generally shown at 12, onto which a rocker housing, generally shown at 14, is mounted by bolts, or the like. The housing 14 is open at its top and bottom and surrounds a number of moving, working parts of the engine, including a plurality of rocker arm assemblies 16, as is well known in the art. The engine 10 has a plurality of piston cylinders (not shown) in which pistons (not shown) reciprocate. A combustion chamber (not shown) is defined in the cylinder between the head 12 and top of the piston (not shown) into which fuel is introduced via fuel injectors, generally shown at 18, that are mounted on the cylinder head 12 and extend into the chambers (not shown). The fuel injectors 18 operate in well-known manner by metering fuel into the combustion chamber to effect combustion. The fuel injectors 18 are typically controlled by a solenoid 20 or other electronic device which, when energized, controls the operation of the fuel injector 18. Each solenoid 20, or other suitable electrical controller, extends into the cylinder head 12 and is fitted with at least one and preferably a pair of electrical terminals 24. In the embodiment shown, the terminals 24 comprise threaded studs or posts adapted to receive a mating female connector of a power supply.

Figure 2:
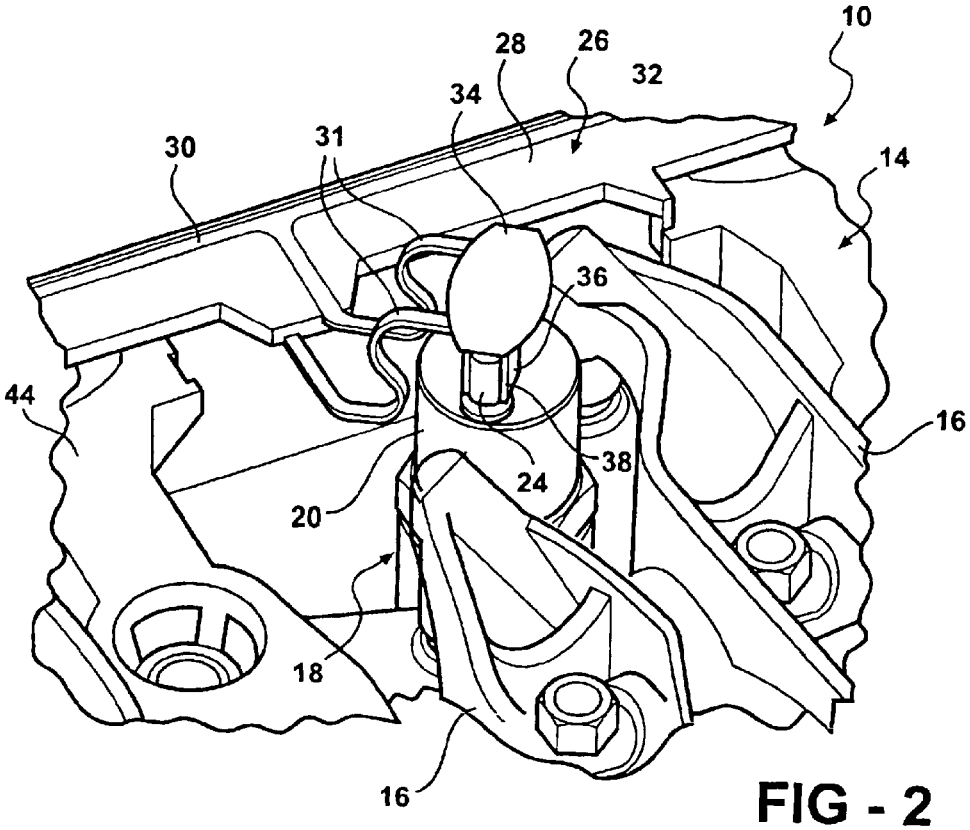
FIG. 2 is an enlarged fragmentary perspective view showing a connector of the lead circuit of FIG. 1 joined with an associated fuel injector.
Figure 3:
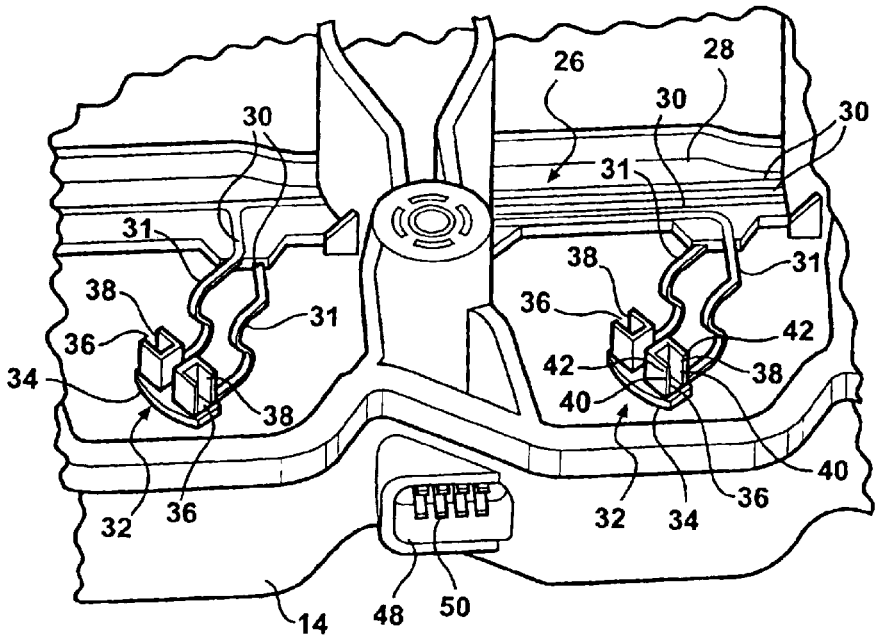
FIG. 3 is an enlarged fragmentary perspective view showing details of the stamped lead frame circuit and associated connectors.
Figure 4:
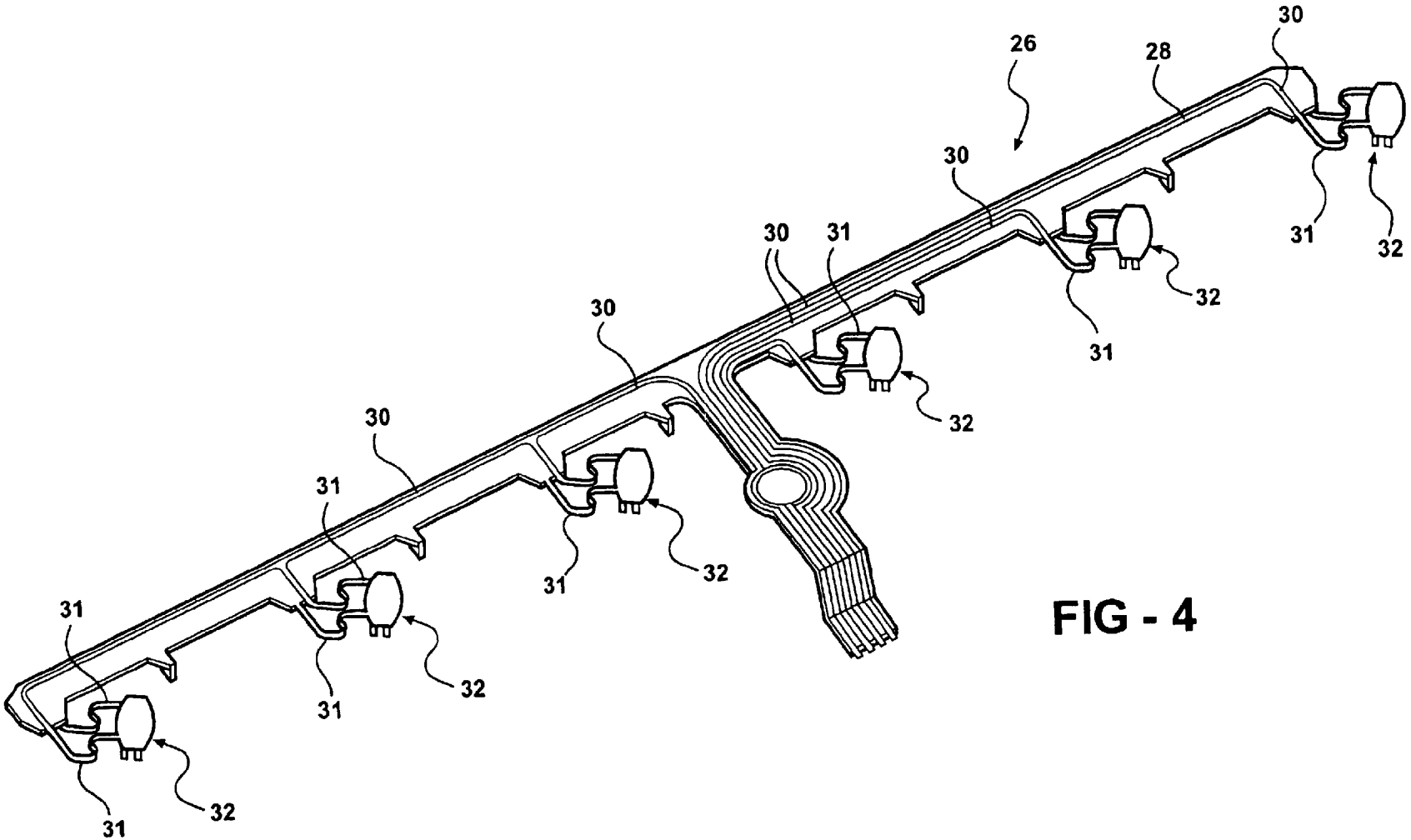
FIG. 4 is a perspective view of the stamped lead frame circuit of FIGS. 1 through 3.

According to the invention, electrical power from the electrical system of the engine is supplied to the individual solenoids 20 via a separately formed lead frame module, generally shown at 26. The lead frame module 26 comprises a frame 28 fabricated of a self-supporting plastics material in which stamped metallic lead ribbons 30 are molded in place. As illustrated, the engine 10 is shown having six fuel injectors 18, each having two terminals 24 of reverse or opposite polarity. Accordingly, the lead frame module 26 has six sets of metal lead ribbons 30 and a plurality of self-sustaining support portions 31 extending between the frame 28 and the terminal connectors 32, which, in turn, attach to the terminals 24 of the injectors 18. Each connector 32 has a plastic body 34 molded to a terminal end of each associated support portion 31. As best shown in FIGS. 2 and 3, each connector body 34 serves two adjacent ones of the terminals 24. Each connector 32 thus has a pair of terminal sockets 36 that are open at the bottom for press-on installation over the pairs of terminals 24 of each injector 18. Within, each socket 36 there is a resilient metal connector lead 38, or electrical contact, which is coupled electrically to the associated lead ribbons 30 and configured to engage and grip the respective terminals 24. The connector leads 38 each comprise a generally U-shaped insert having opposing spring arms 40 carrying contact fingers or undulations 42 adjacent their free or distal ends. The spring arms 40 are disposed on opposite sides of the open bottom of the connector socket 36 and are spaced from the sidewalls of the socket 36. The contact fingers 42 are spaced from one another by a distance less than the diameter of the terminals 24. Extending the terminals 24 of the injectors 18 into the sockets 36 cause the contact fingers 42 and thus the spring arms 40 to deflect laterally outwardly against a constantly applied inwardly return force applied by the resilient spring arms 40. With a threaded terminal 24, the fingers 42 ratchet across the threads and, when fully inserted, are caused to seat within a valley between adjacent threads. The inward gripping action and interference with the threads imparts a constant resistance force against inadvertent disconnection of the connectors 32 from the terminals 24.

It will be appreciated that the same push in-type connection approach could be used with other than a threaded terminal configuration of the injectors 18. For example, if the solenoid 20 of the fuel injectors 18 were fitted with blade-type terminals, the connector leads 38 of the connectors 32 would be appropriately configured to engage and make contact with such a terminal configuration in response to pushing the connection 32 into engagement with the terminal. Accordingly, the invention contemplates and incorporates herein by reference any combination of terminal/connector configurations that would enable the two to be electrically connected by pushing then into contact with one another.

It is to be understood that the bendable support portions 31 of the ribbons 30 support the connectors 32 out away from the body 34 in a stationary, but positionable, i.e., movable relative to the frame 28, location in response to bending the elastically support portions 31. The ribbons 30 and support portions 31 may be fabricated of copper, coated copper, aluminum, or the like, depending on the particular requirements of a given application. The connector leads 38 may likewise be fabrication of copper, coated copper, aluminum, or the like.

The lead frame module 26 is fabricated as a separate structure from the rocker housing 14 and has an outline corresponding generally to an upper support surface region of the rocker housing 14. The lead frame module 26 is disposed in overlying relation on the upper surface support portion 44. The support portion 44 is preferably inset from an upper sealing surface 45 to which a cover mounts to the rocker housing 14 to enclose the housing 14 and its components.

Additionally, the lead frame module 26 extends through an opening 48 in the rocker housing 14 and terminates in a multi-prong plug or fitting 50 for connection to an incoming power supply of the engine's electrical system (not shown).

Accordingly, the invention provides an independent electrical module 26 for distributing an electrical signal to the terminals 24 of one of an ignition and a fuel injector device in an engine. The module 26 comprises a self-supporting lead frame 28 consisting of an organic polymeric or plastic material with metal ribbons 30 of electrically conductive material (e.g., copper) disposed on the plastic frame 28. Pluralities of terminal connectors 32 are separate from and movable relative to the frame 28 for being connected to the terminals. The ribbons 30 continue in a free and self-sustaining support portion 31 between the frame 28 and the terminal connectors 32. The support portions 31 are bendable for allowing movement of the connectors 32 relative to the frame 28. Each of the connectors 32 includes a polymeric body defining at least one terminal socket 36 and an electrical contact 38 in the socket 36. More specifically, each of the connectors 32 includes a pair of the sockets 36 with one of the electrical contacts 38 in each of the sockets 36 and a pair of the bendable support portions 31 are associated with each connector 32 and are paired with the contacts 38 in the associated sockets 36.

As alluded to above, a power plug 50 is connected electrically to the ribbons 30 for connection to an engine control.

It is to be understood that other embodiments of the invention that accomplish the same function are incorporated herein within the scope of any ultimately allowed patent claims.

What is claimed is:

1. An internal combustion engine comprising;

a rocker housing, at least one of an ignition and a fuel injector device supported on said rocker housing and having at least one electrical terminal, an electrical module supported by said rocker housing for distributing an electrical signal to said terminal and including a self-supporting frame with ribbons of electrically conductive material disposed on said frame and a plurality of terminal connectors separate from and movable relative to said frame, said ribbons extending from said frame in a continuous manner to form elastically deformable support portions electrically coupling said connectors to said frame, said elastically deformable support portions supporting said connectors in a predetermined spatial position relative to said frame and enabling said connectors to be displaced out of said spatial position in response to application of a force causing elastic deformation of said support portions for connecting said connectors to said terminal, and enabling a return of said connectors to said spatial position in response to a removal of said force.

2. An engine as set forth in claim 1 wherein said frame consists of polymeric material and said ribbons consist of metal.

3. An engine as set forth in claim 1 wherein each of said connectors includes a polymeric body defining at least one terminal socket and an electrical contact in said socket connected to said terminal.

4. An engine as set forth in claim 3 wherein each of said connectors includes a pair of said sockets with one of said electrical contacts in each of said sockets with said ribbons consisting of metal, and including a pair of said support portions associated with each connector and paired with said contacts in said sockets.

5. An engine as set forth in claim 4 including a power plug connected electrically to said ribbons for connection to an engine control.

6. An engine as set forth in claim 5 including a valve cover covering said rocker housing with said frame being covered by said valve cover.

7. An engine as set forth in claim 1 wherein said elastically deformable support portion has a S-shaped configuration to enable said return of said connectors to said spatial position.

8. An electrical module for distributing an electrical signal to the terminals of one of an ignition and a fuel injector device in an engine and comprising;

a self-supporting frame, ribbons of electrically conductive material disposed on said frame, and a plurality of terminal connectors separate from and movable relative to said frame for being connected to the terminals, said ribbons extending from said frame in a continuous manner to form elastically deformable support portions electrically coupling said connectors to said frame, said elastically deformable support portions supporting said connectors in a predetermined spatial position relative to said frame and enabling said connectors to be displaced out of said spatial position in response to application of a force causing elastic deformation of said support portions, and enabling a return of said connectors to said spatial position in response to a removal of said force.

9. A module as set forth in claim 8 wherein said frame consists of polymeric material and said ribbons consist of metal.

10. A module as set forth in claim 8 wherein each of said connectors includes a polymeric body defining at least one terminal socket and an electrical contact in said socket.

11. A module as set forth in claim 10 wherein each of said connectors includes a pair of said sockets with one of said electrical contacts in each of said sockets with said ribbons consisting of metal and including a pair of said support portions associated with each connector and paired with said contacts in said sockets.

12. A module as set forth in claim 11 including a power plug connected electrically to said ribbons for connection to an engine control.

13. A module as set forth in claim 8 wherein said elastically deformable support portion has a S-shaped configuration to enable said return of said connectors to said spatial position.

* * * * *